United States Patent [19]

Keeffe et al.

[11] Patent Number: 4,916,351

[45] Date of Patent: Apr. 10, 1990

[54] ARC TUBE HAVING CRYSTALLINE PRESS SEAL PENETRATION SUPPRESSION MEANS AND LAMP EMPLOYING SAME

[75] Inventors: William M. Keeffe, Rockport, Mass.; Robert Karlotski, Weare, N.H.

[73] Assignee: GTE Products Corporation, Danvers, Mass.

[21] Appl. No.: 229,931

[22] Filed: Aug. 8, 1988

[51] Int. Cl.[4] ..... H01J 61/34; H01J 61/10

[52] U.S. Cl. ..... 313/25; 313/613; 313/623; 313/631; 313/634

[58] Field of Search ..... 313/25, 634, 623, 573, 313/574, 601, 613, 631, 306, 307

[56] References Cited

U.S. PATENT DOCUMENTS

| | | | |
|---|---|---|---|
| 1,985,028 | 12/1934 | Gehrts | 250/27.5 |
| 4,056,751 | 11/1977 | Gungle et al. | 313/623 |
| 4,208,603 | 6/1980 | Graves et al. | 313/25 X |

*Primary Examiner*—Kenneth Wieder
*Attorney, Agent, or Firm*—Joseph S. Romanow

[57] ABSTRACT

An arc tube for horizontal operation and arc discharge lamp employing same wherein the arc tube has devices in each end for suppressing crystalline deposit penetration into the arc tube press seals along the shanks of the main electrodes. Experimental evidence shows that crystalline penetration into a press seal weakens the press seal and is the likely cause of an occasional arc tube burst during lamp operation, a problem well known in the art. In a preferred embodiment, a starting electrode is mounted above the main electrode in each end of the operationally positioned arc tube. So placed, each starting electrode is upstream in the convective flow of the gaseous fill within the arc tube. Each starting electrode may be electrically coupled with the lamp's circuit or electrically isolated therefrom without substantially affecting the starting electrode's ability to suppress crystalline penetration of the press seal about the base of the adjacent main electrode. In a lamp in accordance with the invention, the probability of an arc tube burst during lamp operation has been substantially reduced and, consequently, the need for employment of protective measures or containment devices has been substantially reduced.

40 Claims, 4 Drawing Sheets

ARC TUBE HAVING CRYSTALLINE PRESS SEAL PENETRATION SUPPRESSION MEANS AND LAMP EMPLOYING SAME

TECHNICAL FIELD

This invention relates to arc discharge lamps having arc tubes intended for horizontal or near horizontal operation and more particularly to such arc tubes which include means for reducing the probability that the arc tube will burst during lamp operation.

BACKGROUND ART

In an arc discharge lamp, there is a small probability that the arc tube will burst during lamp operation. The cause of such a burst is unknown and unpredictable. There is no known way to eliminate the possibility of this type of burst. Although an arc tube burst occurs infrequently, there may be a safety hazard to persons or property in the immediate surroundings as a result of such a burst. Consequently, protective measures must be taken.

One protective measure is to require that an arc discharge lamp be operated within a fixture or enclosure capable of withstanding a lamp burst. This procedure has several drawbacks including the facts that a protective fixture may not always be available and removal of a burst lamp from a protective fixture may present a safety concern of a different nature.

A preferred protective measure is to provide a lamp capable of self containment. There are numerous devices which may be incorporated in an arc discharge lamp for the purpose of containing within the outer envelope the forces and shards emanating from an arc tube burst. By so containing the burst, the potential hazard to persons and property is virtually eliminated even when a protective enclosure is not employed.

Examples of typical self-containment devices are as follows. A glass shield may be placed within the outer envelope surrounding the arc tube. The shield may be reinforced with a metal or fibrous mesh. The wall thickness of the outer envelope may be increased. A thick-walled outer envelope may be employed in combination with a shield. A protective coating may be applied to the outer envelope, shield, or both. These containment devices, while necessary and effective, nevertheless increase the cost of a lamp and may adversely affect lamp performance to some degree.

While a protective enclosure or containment device may effectively negate the external effects of an arc tube burst, neither attacks the basic problem of the cause of the burst. Needless to say, there would be no need for either safeguard if the cause of the burst were removed. It would be a substantial advancement of the art if an arc tube were provided for which the possibility of a burst during normal lamp operation were virtually eliminated.

The following prior art is believed to be pertinent to the invention. In U.S. Pat. No. 3,858,078, issued Dec. 31, 1974, to Koury, there is shown an arched arc tube for horizontal operation having a starting or auxiliary electrode in one end of the arc tube. In Gungle et al., U.S. Pat. No. 4,056,751, issued Nov. 1, 1977, there is disclosed an arched arc tube for horizontal operation wherein the electrodes are positioned below the central axis of the arc tube. Karlotski et al., U.S. Pat. No. 4,498,027, issued Feb. 5, 1985, discloses an arched arc tube for horizontal operation wherein the lower wall has lesser curvature than the upper wall such that there is a straight line of sight between the electrodes unimpeded by the curvature of the lower wall. Koza, in U.S. Pat. No. 4,142,122, issued Feb. 27, 1979, describes a lamp intended to be mounted vertically which has an arched arc tube for horizontal operation.

A straight arc tube for horizontal operation is shown in Howles et al., U.S. Pat. No. 4,001,623, issued Jan. 4, 1977. The arc tube of Howles et al. has a cylindrical body and electrodes positioned below the central axis of the operationally positioned arc tube. U.S. Pat. No. 4,232,243, issued Nov. 4, 1980, is another example of an straight cylindrical arc tube intended for horizontal operation having offset electrodes.

In U.S. Pat. No. 3,614,508, issued Oct. 19, 1971, to Ito et al., there is disclosed a metal halide discharge lamp having a starting electrode adjacent each main electrode in each end of the arc tube. Each starting electrode of Ito et al. is electrically coupled with the opposite main electrode. Nakamura shows another example of an arc discharge lamp having two auxiliary electrodes with each auxiliary electrode being electrically coupled with the opposite main electrode.

In Wynér et al., U.S. Pat. No. 4,323,812, issued Apr. 6, 1982, there is disclosed an arc discharge lamp having an arc tube with a starting probe adjacent a main electrode in one end thereof wherein the starting probe is electrically isolated at all times from any ohmic contact with any other electrode of the lamp and from any ohmic contact or capacitive contact from associated ballast circuitry.

DISCLOSURE OF THE INVENTION

It is, therefore, an object of the invention to obviate the deficiencies in the prior art and to make a significant contribution to the field of arc discharge lamps and, more particularly, to the field of arc discharge lamps employing arc tubes intended for horizontal or near horizontal operation.

Another object of the invention is to provide an arc tube for horizontal operation in an arc discharge lamp wherein the the probability of an arc tube burst during normal lamp operation has been substantially reduced.

A further object of the invention is to provide an arc tube for horizontal operation in an arc discharge lamp wherein the arc tube has devices for suppressing the penetration of crystalline deposits into the press seals along the shanks of the main electrodes of the arc tube.

Still another object of the invention is to provide an arc discharge lamp having an arc tube intended to operate horizontally which may be operated with an improved margin of safety without a protective enclosure or a self-containment device.

Yet another object of the invention is to advance the state of the arc discharge lamp art by disclosing a structure for an arc tube which is effective in substantially removing the cause of the well known problem of unpredictable arc tube bursts during normal lamp operation, at least in arc tubes designed for horizontal or near horizontal operation, and in so doing, to provide a first step or clue to an identification and understanding of the physical cause underlying this long standing problem.

These objects are accomplished, in one aspect of the invention, by provision of an arched arc tube for an arc discharge lamp. The arc tube has an arched central axis and is designed to operate with the central axis arched upward. The arc tube comprises an arched light-transmissive body hermetically enclosing an interior. The body has first and second opposed ends. The first end has a first press seal formed in it, and the second end has a second press seal formed in it.

A fill gas is provided within the interior of the arc tube. The fill gas is capable of sustaining a light-producing electrical arc therethrough. There are first and second electrodes protruding into the interior. The first electrode is imbedded in the first press seal, and the second electrode is imbedded in the second press seal.

There are first and second crystalline press seal penetration suppressing means protruding into the interior of the arc tube. The first suppression means is positioned above the first electrode and the second suppression means is positioned above the second electrode when the arc tube is operationally positioned.

In a second aspect of the invention, there is provided an arc tube for an arc discharge lamp wherein the arc tube has a straight central axis. The arc tube is designed to operate with the central axis substantially horizontal and with a predetermined portion of the arc tube facing upward during lamp operation. The arc tube comprises a straight cyclindrical light-transmissive body hermetically enclosing an interior. The body has first and second opposed ends. The first end has a first press seal formed in it, and the second end has a second press seal formed in it.

A fill gas is provided within the interior of the arc tube. The fill gas is capable of sustaining a light-producing electrical arc therethrough. There are first and second electrodes protruding into the interior of the arc tube. The first electrode is imbedded in the first press seal, and the second electrode is imbedded in the second press seal.

There are first and second crystalline press seal penetration suppressing means protruding into the interior of the arc tube. The first suppression means is positioned above the first electrode and the second suppression means is positioned above the second electrode when the arc tube is operationally positioned.

In a third aspect of the invention, there is provided an arc discharge lamp employing an arched arc tube for horizontal or near horizontal operation as described above in the first aspect of the invention. The arc tube is mounted within a light-transmissive outer envelope. There are means, including two lead in wires, for providing electrical power to the electrodes of the arc tube from an electrical source outside of the outer envelope. There are means for positioning the lamp such that the arc tube is arched upward during lamp operation.

In a fourth aspect of the invention, there is provided an arc discharge lamp employing an straight cylindrical arc tube for horizontal or near horizontal operation as described above in the second aspect of the invention. The arc tube is mounted within a light-transmissive outer envelope. There are means, including two lead in wires, for providing electrical power to the electrodes of the arc tube from an electrical source outside of the outer envelope. There are means for positioning the lamp such that a predetermined portion of the arc tube is positioned upward during lamp operation.

BEST MODE FOR CARRYING OUT THE INVENTION

Figure 1:
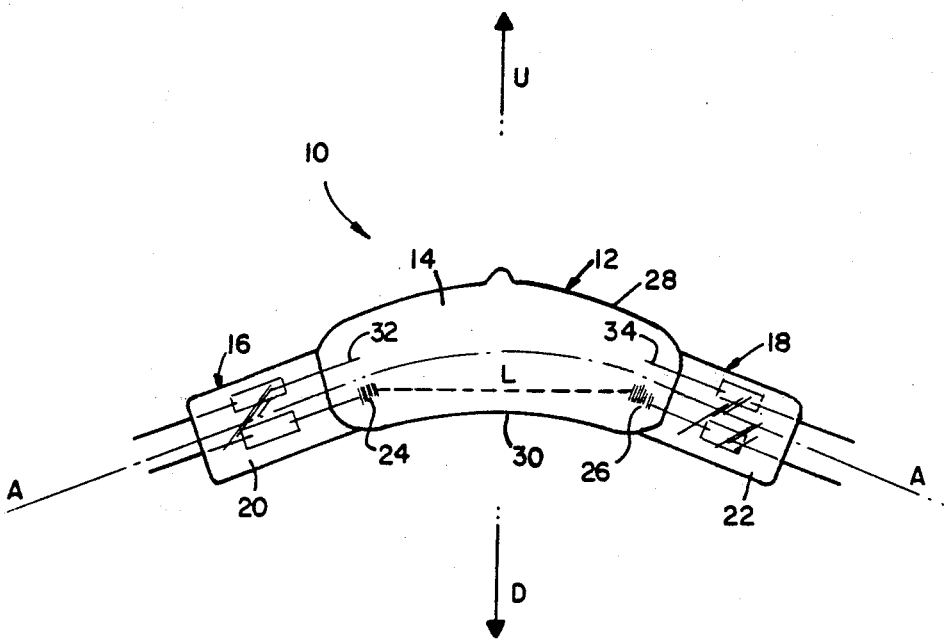
FIG. 1 is an elevational view of an arched arc tube for horizontal operation having crystalline press seal penetration suppression means in accordance with the invention.

For a better understanding of the present invention, together with other and further objects, advantages, features, and capabilities thereof, reference is made to the following disclosure and appended claims taken in conjunction with the above-described drawings.

As has been noted, the fact that an arc tube of an arc discharge lamp may burst on rare occasions during lamp operation is well known in the art. In an attempt to discover the root of this problem, numerous observations of arc discharge lamps have been made at various intervals in their operating lives.

In the case of an arc tube designed for horizontal operation having a starting electrode in one end, a substantial build up or deposit of crystalline material occurs about the base of the tungsten electrode in the end which does not contain the starting electrode. As the accumulation increases with the age of the lamp, the crystalline material surrounds the base of the electrode abutting the press seal and eventually penetrates into the press seal along the shank of the electrode. Because the crystalline material has a higher coefficient of thermal expansion than the fused quartz glass of the press seal, the imbedded deposit exerts stress on the press seal when the arc tube is at elevated temperatures. This stress may be greatest during thermal cycling of the lamp, i.e., when the lamp is warming up or cooling off. As the lamp ages further, this stress increasingly weakens the press seal. Occasionally, when the crystalline material is deeply imbedded and the resulting stress becomes excessive, the press seal ruptures causing a burst of the arc tube.

Press seals of aged arc tubes of the prior art were examined. These arc tubes were designed for horizontal operation and contained a single starting electrode in one end. Accumulation of crystalline material about the base of the main electrode occurred, surprisingly, only at the end opposite the starting electrode. In some cases, there was a small accumulation of crystalline material about the middle of the starting electrode above the point where the starting electrode enters the press seal. There was no accumulation about the base of either the starting electrode or the adjacent main electrode and, consequently, no penetration of crystalline material into the press seal. Remnants of burst arc tubes also were examined. In all cases, the press seals containing both the starting and main electrodes were intact while the press seals containing only a main electrode were demolished.

It is believed that the "wedge effect" of the crystalline deposit in the press seal weakens the press seal and is the cause of the occasional burst of the arc tube. Aged press seals which had developed crystalline wedges in the seals were analyzed in an oil bath polariscope with photoelastic stress techniques. The results showed severe tensile stresses in each press seal in the vicinity of the crystalline wedge. It is well known that glass is weak when in tension and strong when in compression. Aged press seals without any penetration of crystalline material were similarly examined. Each of these seals was uniformly in compression.

The chemical composition of accumulated crystalline material was examined by energy dispersive x-ray spectroscopy. Separate analyses were performed for crystalline deposits which penetrated into the press seal and for crystalline deposits which accumulated about the middle of the starting electrodes. In both cases, the chemical compositions of the crystalline deposits were similar. In each case, the elements which were present in the crystalline deposit in the greatest amounts were those elements readily available within the arc tube, such as tungsten, silicon, and elements of the gaseous fill of the arc tube.

The precise nature of the chemical reaction by which the crystalline deposits are formed and deposited is not understood. When a starting electrode is present in an arc tube operating horizontally, the accumulation occurs at the middle of the starting electrode rather than at the base of the adjacent main electrode. In horizontal operation, the starting electrode is positioned above the main electrode. The arc is arched upward during steady state operation and the hottest point or spot within the arc tube is directly above the arc's zenith. Convective currents flow from the uppermost or central hot spot in opposite directions along the upper arc tube wall toward the ends; as the currents approach the ends, they change direction, sweep by the electrodes, and proceed along the lower wall toward the center of the arc tube where they will rise and repeat the cycle.

In this configuration, the starting electrode is upstream in the convective flow relative to the main electrode. Apparently, the starting electrode intercepts the gaseous reactants carried in the convective flow which are required for the formation of the crystalline deposit before the reactants can reach and react with the adjacent main electrode. Alternatively, and perhaps cumulatively, the starting electrode may physically block or divert the flow of reactants away from or around the adjacent main electrode. In any event, experiments clearly demonstrated that the accumulation of crystalline material about the base of the main electrode and its eventual penetration and weakening of the press seal was effectively suppressed by the presence of the starting electrode above the main electrode.

This being the case, laboratory examples of lamps having arc tubes for horizontal operation were constructed with crystalline press seal penetration suppression means above the main electrode in both ends of the arc tube. In preferred embodiments, a second starting electrode was mounted above the main electrode in the end of the arc tube which formerly did not have a starting electrode. In some cases, the second starting electrode was electrically coupled with the opposite main electrode during lamp start-up. In other cases, the second starting electrode was electrically isolated from the electrical circuit of the lamp at all times. In either configuration, crystalline deposits about the bases of both electrodes were effectively suppressed and, consequently, crystalline penetration of the press seals was also suppressed. There was no significant difference in the ability to suppress depending on whether either starting electrode was electrically coupled or electrically isolated from the lamp's electrical circuit. After 20,000 hours of lamp operation, there was no instance of a burst arc tube nor was there any evidence of crystalline penetration into a press seal at either end of an arc tube in any laboratory example.

As used herein, the term "electrically coupled" means that there is a physical connection between a starting electrode and a main electrode for some period during lamp operation, such connection being direct or through one or more electrically conductive discrete components; the term "electrically isolated" means that no such electrical coupling exists at any time during lamp operation.

Further tests were conducted to determine if the addition of suppression means, e.g., an additional or second starting electrode, in the arc tube had any deleterious effect on lamp operating characteristics. Measurements of lumens per watt, operating voltage across the arc tube, and color temperature demonstrate that there is no significant differences between the operating characteristics of lamps in accordance with the invention and prior art counterparts. Nor are there any significant differences between these lamp characteristics for second starting electrodes which are electrically coupled as opposed to second starting electrodes which are electrically isolated.

Thus, it is believed that the probability of an arc tube burst in an arc tube or lamp in accordance with the invention has been substantially reduced without causing any adverse effects on the operating performance.

Now turning to the drawings, FIG. 1 is an elevational view of arched arc tube 10 having arched central axis A—A. Arrow D points downward toward the center of the earth, and Arrow U points upward. Arc tube 10 is designed to operate with axis A—A arched upward, so that the arc tube is operationally positioned in the drawing.

Arc tube 10 includes arched light-transmissive body 12 hermetically enclosing interior 14. Body 12 includes first end 16 having first press seal 20 formed in it and second end 18 having second press seal 22 formed in it. Preferably, body 12 is formed from quartz glass.

A gaseous fill (not shown in the drawing) is enclosed within interior 14. The fill is capable of sustaining a light-producing electrical arc through it. In a preferred embodiment of the invention, the fill includes mercury, an inert gas, and one or more metal halide additives. When there is a non-uniform temperature distribution within the arc tube, convection currents are present in the gaseous fill.

First electrode 24 is imbedded in first press seal 20 and second electrode 26 is imbedded in second press seal 22. Electrodes 24 and 26 protrude into interior 14. Electrodes 24 and 26 may also be referred to herein as main electrodes. A preferred material for the electrodes is tungsten. In the preferred embodiment of FIG. 1, main electrodes 24 and 26 are mounted in press seals 20 and 22, respectively, below central axis A—A in order to accommodate optimally the upward bowing of the arc discharge during steady state operation.

In the preferred embodiment of FIG. 1, arc tube 10 has the line-of-sight feature, meaning that lower wall 30 has a lesser degree of curvature (including a straight lower wall, i.e., zero curvature) than does upper wall 28 such that there is a straight line of sight between electrodes 24 and 26 without the line of sight being impeded by lower wall 30. This straight line of sight is shown in the drawing by dashed line L.

First crystalline press seal penetration suppression means 32 is is positioned above first electrode 24 and protrudes into interior 14. Second crystalline press seal penetration suppression means 34 is positioned above second electrode 26 and protrudes into interior 14. In the preferred embodiment of FIG. 1, each suppression means is a secondary or starting electrode formed from tungsten wire and imbedded in the respective press seal. Each starting electrode has a diameter of approximately 0.015 inch and is positioned approximately 0.1 inch above the respective main electrode.

Figure 2:
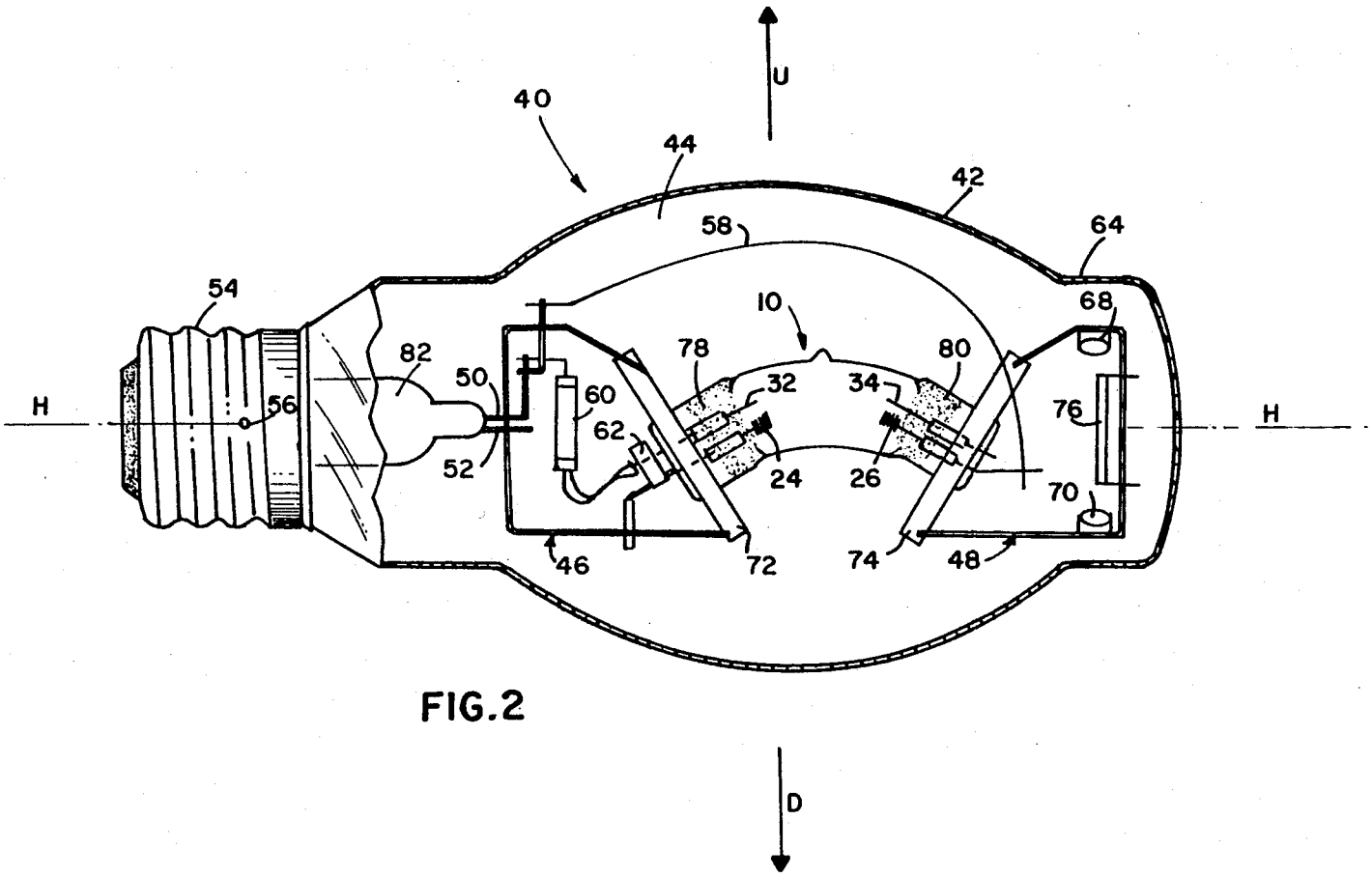
FIG. 2 is an elevational view of an arc discharge lamp employing an arched arc tube for horizontal operation as described in FIG. 1.

FIG. 2 is an elevational view of arc discharge lamp 40 having arched arc tube 10 mounted within light-transmissive outer envelope 42. Typically, outer envelope 42 is formed from hard glass. Lamp 40 is operationally positioned in the drawing with central lamp axis H—H being horizontal. Atmosphere 44 within outer envelope 42 typically is a vacuum or an inert gas, such as nitrogen. Heat-reflective coatings 78 and 80, e.g., zirconium oxide, may be applied to the respective ends of arc tube 10, as shown in the drawing. A suitable getter 76 may be mounted within outer envelope 42 on frame 48.

Arc tube 10 is supported within outer envelope 42 by stiff electrically conductive frames 46 and 48. Clamps 72 and 74 are tightly secured to the respective press seals of arc tube 10. Clamps 72 and 74 are positioned angularly with respect to axis H—H, as shown in the drawing, in order to accommodate the arched shape of arc tube 10. Clamps 72 and 74 are rigidly mounted, e.g., by welding, to frames 46 and 48, respectively. Frame 46 is rigidly connected to lead-in wire 52, e.g., by welding, and frame 48 is supported by the inner wall of dome 64 of outer envelope 42 by means of metal leaf springs 68 and 70.

Stiff electrically conductive lead-in wires 50 and 52 pass through reentrant stem 82 and are connected, respectively, with two external electrical contacts of positioning type base 54. One type of positioning type base is a threaded mogul base with positioning pin 56, as shown in the drawing. Base 54 and pin 56 are positionally mounted on outer envelope 42 such that arc tube 10 is arched upward in operating position when lamp 40 is mounted horizontally in a suitable receiving socket for base 54.

The electrical circuit of lamp 40 is as follows. Main electrode 24 is electrically coupled with lead-in 52 via metal frame 46. Main electrode 26 is electrically coupled with lead-in 50 via electrically conductive connecting wire 58. Starting electrode 32 is electrically coupled with lead-in 50 through resister 60 during lamp start-up. Bimetal switch 62 shorts starting electrode 32 to main electrode 24 after lamp ignition has occurred. Starting electrode 34 is electrically isolated from both lead-in 50 and lead-in 52 at all times. In an alternate embodiment, starting electrode 34 may be electrically coupled with main electrode 24 during lamp start-up and shorted with main electrode 26 after lamp ignition. In yet another alternate embodiment, starting electrode 34 may be electrically coupled with either of main electrodes 24 and 26 at all times. As has been mentioned above, experiments demonstate that the ability of the starting electrode to suppress the penetration of crystalline material into a press seal is substantially independent of whether or not the starting electrode is electrically coupled with the lamp's circuit.

Figure 3:
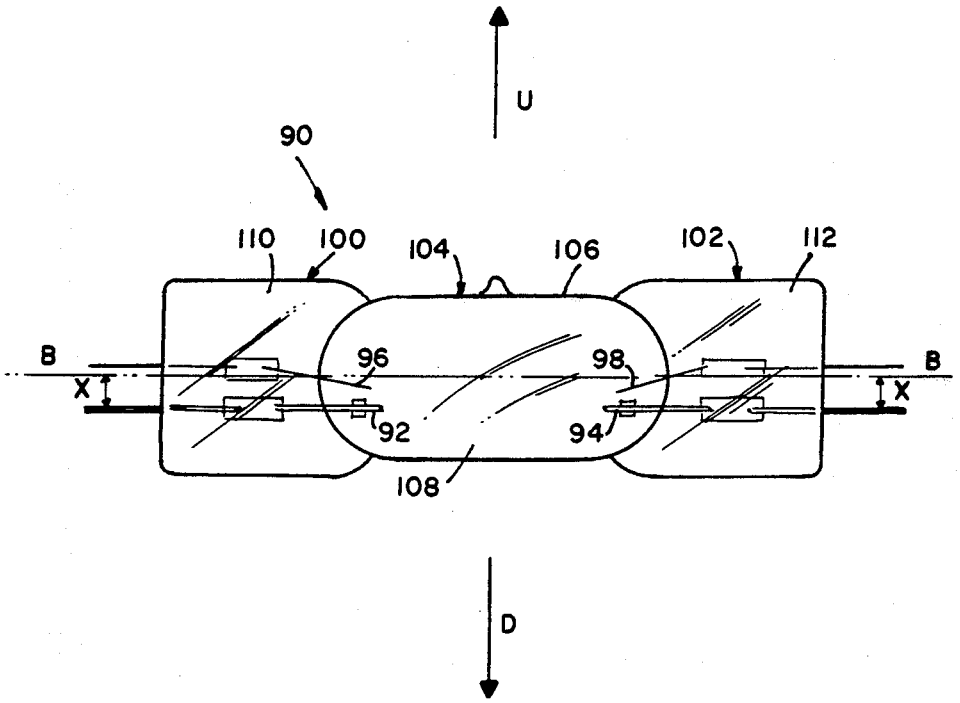
FIG. 3 is an elevational view of a straight cylindrical arc tube having crystalline press seal penetration suppression means in accordance with the invention.

FIG. 3 is an elevational view of straight cylindrical arc tube 90 having straight central axis B—B. Arc tube 90 is designed for operation with axis B—B horizontal or nearly horizontal and with a predetermined portion 106 of the arc tube facing upward during operation.

Arc tube 90 for an arc discharge lamp comprises straight cylindrical light transmissive body 104 hermetically enclosing interior 108. Body 104 has first end 100 including press seal 110 formed in it and second end 102 including press seal 112 formed in it.

A gaseous fill (not shown in the drawings) is enclosed in interior 108. The fill is capable of sustaining a light-producing electrical arc through it. The fill may include mercury, an inert gas, and one or more metal halide additives. When there is a non-uniform temperature distribution within the arc tube, convection currents are present in the gaseous fill.

First electrode 92 is imbedded in first press seal 110 and second electrode 94 is imbedded in second press seal 112. Electrodes 92 and 94 protrude into interior 108. Electrodes 92 and 94 may also be referred to herein as main electrodes. In the embodiment of FIG. 3, main electrodes 92 and 94 are mounted, e.g., by imbedding, in press seals 110 and 112, respectively, below central axis B—B, by an offset distance x, so that the upwardly bowed arc will be more centrally located within body 104 during operation of the arc tube.

First crystalline press seal penetration suppression means 96 is is positioned above first electrode 92 and protrudes into interior 108. Second crystalline press seal penetration suppression means 98 is positioned above second electrode 94 and protrudes into interior 108. In the embodiment of FIG. 3, each suppression means is a secondary or starting electrode formed from tungsten wire and imbedded in the respective press seal.

Straight arc tube 90 may be mounted within outer envelope 42 of lamp 40, sown in FIG. 2, in precisely the same manner as described above with regard to arched arc tube 10 except that frames 46 and 48 may be adapted such that clamps 72 and 74, respectively, are substantially Perpendicular to axis H—H in order to accommodate the straight arc tube. By so doing, there is provided an arc discharge lamp for horizontal operation having a straight cylindrical arc tube with means for suppressing crystalline penetration into the press seals. Everything (other than the mounting of the arched arc tube) stated above regarding lamp 40 is equally valid for the lamp with straight arc tube, including the discussion pertaining to the various electrical circuits and electrical couplings of the main and starting electrodes.

Figure 4:
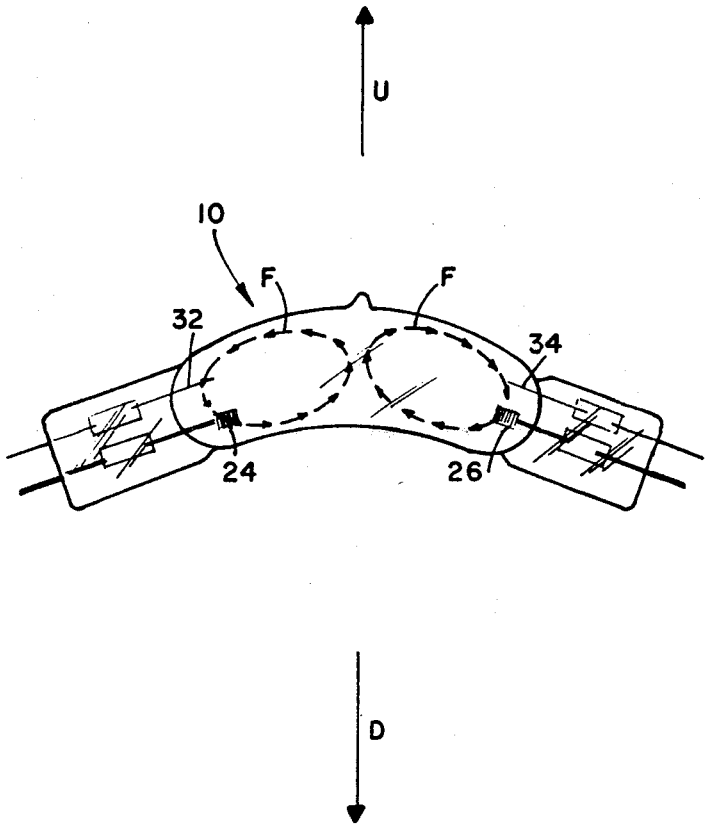
FIG. 4 is a pictorial view of the approximate convective flow of the gaseous fill within an operationally positioned arched arc tube of FIG. 1 during steady state operation.

FIG. 4 shows the approximate convective flow of the gaseous fill within operationally positioned arched arc tube 10 during steady state operation. As may be seen in the drawing, the fill gas flows from the central upper region in opposite directions along the upper wall toward the electrodes in each end, changes direction, sweeps by the two electrodes in each end, and proceeds along the lower wall toward the center where it rises and repeats the cycle. Both starting electrodes 32 and 34 are positioned upstream in the convective flow relative to main electrodes 24 and 26, respectively. So positioned, each starting electrode effectively suppresses any penetration of crystalline deposit into the press seal about the base of the adjacent main electrode. A similar convective flow pattern will occur in arc tube 90 of FIG. 3.

While there have been shown and described what are at present considered to be the preferred embodiments of the invention, it will be apparent to those skilled in the art that various changes and modifications can be made herein without departing from the scope of the invention as defined by the appended claims.

We claim:

1. An arched arc tube for an arc discharge lamp, said arc tube having an arched central axis and being designed to operate with said central axis arched upward, said arc tube comprising:

(a) an arched light-transmissive body hermetically enclosing an interior, said body having first and second opposed ends, said first end having a first press seal formed therein, said second end having a second press seal formed therein;

(b) a fill gas within said interior, said fill gas being capable of sustaining a light-producing electrical arc therethrough;

(c) first and second electrodes protruding into said interior, said first electrode being imbedded in said first press seal, said second electrode being imbedded in said second press seal; and (d) first and second crystalline press seal penetration suppressing means protruding into said interior, said first suppression means being positioned above said first electrode and said second suppression means being positioned above said second electrode when said arc tube is operationally positioned.

2. An arc tube as described in claim 1 wherein said arched body includes an upper and lower wall, and said lower wall has lesser curvature than said upper wall such that there is a straight line of sight between said electrodes without said line of sight being impeded by said lower wall.

3. An arc tube as described in claim 1 wherein said electrodes are positioned below said central axis when said arc tube is operationally positioned.

4. An arc tube as described in claim 1 wherein a portion of said first suppressing means is imbedded in said first press seal.

5. An arc tube as described in claim 1 wherein at least one of said first and second suppression means includes an electrically conductive material.

6. An arc tube as described in claim 4 wherein at least one of said first and second suppression means is a metal rod.

7. An arc tub as described in claim 6 wherein said metal rod includes tungsten.

8. An arc tube as described in claim 4 wherein said first suppression means is an auxiliary electrode and said second suppression means is a metal rod.

9. An arc tube as described in claim 1 wherein said fill gas includes a metal halide additive.

10. An arched arc tube as described in claim 1 wherein said first and second crystalline press seal penetration suppressing means are formed from electrically conductive material and each of said suppression means extends from outside said arc tube, passes through said respective press seal, and protrudes into said interior of said arc tube.

11. An arc discharge lamp comprising:

(a) a light-transmissive outer envelope;

(b) an arched arc tube mounted within said outer envelope, said arc tube having an arched central axis and being designed to operate with said central axis arched upward, said arc tube including:

(i) an arched light-transmissive body hermetically enclosing an interior, said body having first and second opposed ends, said first end having a first press seal formed therein, said second end having a second press seal formed therein;

(ii) a fill gas within said interior, said fill gas being capable of sustaining a light-producing electrical arc therethrough;

(iii) first and second electrodes protruding into said interior, said first electrode being imbedded in said first press seal, said second electrode being imbedded in said second press seal; and (iv) first and second crystalline press seal penetration suppressing means protruding into said interior, said first suppression means being positioned above said first electrode and said second suppression means being positioned above said second electrode when said arc tube is operationally positioned;

(c) means for mounting said arc tube within said outer envelope;

(d) means including two lead-in wires for providing electrical power to said electrodes from an electrical source outside of said outer envelope; and (e) means for positioning said lamp such that said arc tube is arched upward during lamp operation.

12. A lamp as described in claim 11 wherein said arched body includes an upper and lower wall, and said lower wall has lesser curvature than said upper wall such that there is a straight line of sight between said electrodes without said line of sight being impeded by said lower wall.

13. A lamp as described in claim 11 wherein said electrodes are positioned below said central axis when said arc tube is operationally positioned.

14. A lamp as described in claim 11 wherein a portion of said first suppressing means is imbedded in said first press seal.

15. A lamp as described in claim 11 wherein at least one of said first and second suppression means includes an electrically conductive material.

16. A lamp as described in claim 14 wherein at least one of said first and second suppression means is a metal rod.

17. A lamp as described in claim 16 wherein said metal rod includes tungsten.

18. A lamp as described in claim 14 wherein said first suppression means is an auxiliary electrode to facilitate lamp starting and said second suppression means is a metal rod, said metal rod being electrically isolated from both of said lead-in wires.

19. A lamp as described in claim 14 wherein said first suppression means is an auxiliary electrode to facilitate lamp starting and said second suppression means is a metal rod, said metal rod being electrically coupled with one of said electrodes.

20. A lamp as described in claim 11 wherein said fill gas includes a metal halide additive.

21. An arc discharge lamp as described in claim 11 wherein said first and second crystalline press seal penetration suppressing means are formed from electrically conductive material and each of said suppression means extends from outside said arc tube, passes through said respective press seal, and protrudes into said interior of said arc tube.

22. An arc tube for an arc discharge lamp, said arc tube having a straight central axis and being designed to operate with said central axis substantially horizontal and with a predetermined portion of said arc tube facing upward during lamp operation, said arc tube comprising:

(a) a straight cyclindrical light-transmissive body hermetically enclosing an interior, said body having first and second opposed ends, said first end having a first press seal formed therein, said second end having a second press seal formed therein;

(b) a fill gas within said interior, said fill gas being capable of sustaining a light-producing electrical arc therethrough;

(c) first and second electrodes protruding into said interior, said first electrode being imbedded in said first press seal, said second electrode being imbedded in said second press seal; and (d) first and second crystalline press seal penetration suppressing means protruding into said interior, said first suppression means being positioned above said first electrode and said second suppression means being positioned above said second electrode when said arc tube is operationally positioned.

23. An arc tube as described in claim 22 wherein a portion of said first suppression means is imbedded in said first press seal.

24. An arc tube as described in claim 22 wherein at least one of said first and second suppression means includes an electrically conductive material.

25. An arc tube as described in claim 23 wherein at least one of said first and second suppression means is a metal rod.

26. An arc tube as described in claim 25 wherein said metal rod includes tungsten.

27. An arc tube as described in claim 23 wherein said first suppression means is an auxiliary electrode and said second suppression means is a metal rod.

28. An arc tube as described in claim 22 wherein said fill gas includes a metal halide additive.

29. An arc tube as described in claim 22 wherein said electrodes are positioned below said central axis when said arc tube is operationally positioned.

30. An arc tube as described in claim 22 wherein said first and second crystalline press seal penetration suppressing means are formed from electrically conductive material and each of said suppression means extends from outside said arc tube, passes through said respective press seal, and protrudes into said interior of said arc tube.

31. An arc discharge lamp comprising:

(a) a light-transmissive outer envelope;

(b) an arc tube mounted within said outer envelope, said arc tube having a straight central axis and being designed to operate with said central axis substantially horizontal and with a predetermined portion of said arc tube facing upward during lamp operation, said arc tube including:

(i) a straight cylindrical light-transmissive body hermetically enclosing an interior, said body having first and second opposed ends, said first end having a first press seal formed therein, said second end having a second press seal formed therein;

(ii) a fill gas within said interior, said fill gas being capable of sustaining a light-producing electrical arc therethrough;

(iii) first and second electrodes protruding into said interior, said first electrode being imbedded in said first press seal, said second electrode being imbedded in said second press seal; and (iv) first and second crystalline press seal penetration suppressing means protruding into said interior, said first suppression means being positioned above said first electrode and said second suppression means being positioned above said second electrode when said arc tube is operationally positioned;

(c) means for mounting said arc tube within said outer envelope;

(d) means including two lead-in wires for providing electrical power to said electrodes from an electrical source outside of said outer envelope; and (e) means for positioning said lamp such that said arc tube is operationally positioned during lamp operation.

32. A lamp as described in claim 31 wherein a portion of said first suppression means is imbedded in said first press seal.

33. A lamp as described in claim 31 wherein at least one of said first and second suppression means includes an electrically conductive material.

34. A lamp as described in claim 32 wherein at least one of said first and second suppression means is a metal rod.

35. A lamp as described in claim 34 wherein said metal rod includes tungsten.

36. A lamp as described in claim 32 wherein said first suppression means is an auxiliary electrode to facilitate lamp starting and said second suppression means is a metal rod, said metal rod being electrically isolated from both of said lead-in wires.

37. A lamp as described in claim 32 wherein said firs suppression means is an auxiliary electrode to facilitate lamp starting and said second suppression means is a metal rod, said metal rod being electrically coupled with one of said electrodes.

38. A lamp as described in claim 31 wherein said fill gas includes a metal halide additive.

39. An arc tube as described in claim 31 wherein said electrodes are positioned below said central axis when said arc tube is operationally positioned.

40. An arc discharge lamp as described in claim 31 wherein said first and second crystalline press seal penetration suppressing means are formed from electrically conductive material and each of said suppression means extends from outside said arc tube, passes through said respective press seal, and protrudes into said interior of said arc tube.

* * * * *